US006347819B1

(12) United States Patent
Plaxco

(10) Patent No.: US 6,347,819 B1
(45) Date of Patent: Feb. 19, 2002

(54) SAFETY LATCHING MECHANISM

(76) Inventor: Shawn Plaxco, 9231 Shamouti, Riverside, CA (US) 92508

( * ) Notice: Subject to any disclaimer, the term of this patent is extended or adjusted under 35 U.S.C. 154(b) by 0 days.

(21) Appl. No.: 09/396,224

(22) Filed: Sep. 15, 1999

(51) Int. Cl.[7] ..... E05B 63/20
(52) U.S. Cl. ..... 292/336; 292/230; 292/238; 292/228
(58) Field of Search ..... 292/230, 238, 292/235, 228, 225, 332, 336

(56) References Cited

U.S. PATENT DOCUMENTS

| | | | | |
|---|---|---|---|---|
| 303,225 A | | 8/1884 | Jordan | |
| 1,429,389 A | | 9/1922 | Weintz | |
| 1,965,336 A | | 7/1934 | Fitz Gerald | 70/46 |
| 2,666,660 A | | 1/1954 | Youngworth | 292/68 |
| 3,083,561 A | | 4/1963 | Sussina | 70/139 |
| 3,266,831 A | * | 8/1966 | Banse | 292/235 X |
| 3,774,947 A | | 11/1973 | Duncan | 292/68 |
| 3,918,753 A | | 11/1975 | McCormick et al. | 292/216 |
| 4,111,475 A | | 9/1978 | McCormick et al. | 292/216 |
| 4,305,611 A | * | 12/1981 | Robins | 292/238 |
| 4,387,916 A | | 6/1983 | Lening et al. | 292/5 |
| 4,871,203 A | * | 10/1989 | Rogers | 292/238 |
| 5,016,928 A | | 5/1991 | Segovia | 292/213 |
| 5,103,658 A | | 4/1992 | McQuade | 70/77 |
| 5,498,041 A | * | 3/1996 | Bezzerides et al. | 292/255 |

FOREIGN PATENT DOCUMENTS

| | | | | |
|---|---|---|---|---|
| AU | 122 131 | * | 9/1946 | 292/238 |

* cited by examiner

*Primary Examiner*—Teri Pham Luu
(74) *Attorney, Agent, or Firm*—Stetina Brunda Garred & Brucker

(57) ABSTRACT

In accordance with the present invention, there is provided a latching assembly for securing a gate having a bolt extending therefrom. The latching assembly is provided with a housing and a bolt retaining member pivotally connected to the housing. The bolt retaining member has a retaining portion. The bolt retaining member has open and closed positions with the bolt retaining member being biased in the closed position. The latching assembly is further provided with a trigger connected to the housing. The trigger has locked and unlocked positions with the trigger being biased in the locked position. The trigger has a contact portion sized and configured to contact a bolt when the trigger mechanism is in the locked position. The trigger further has a locking portion sized and configured to engage the bolt retaining member when the bolt retaining member is in the open position and the trigger is in the locked position. The retaining portion and the contact portion are cooperatively sized and configured to retain a bolt therebetween when the bolt retaining member is in the closed position and the trigger is in the unlocked position.

24 Claims, 3 Drawing Sheets

SAFETY LATCHING MECHANISM

FIELD OF THE INVENTION

The present invention relates generally to latching assemblies, and more particularly to a latching assembly for engaging a bolt.

BACKGROUND OF THE INVENTION

Latching devices for use with gates, doors and the like are generally known in the art. In a common configuration a gate is provided rotates relative to a gate frame. A bolt is attached to and radially extends from the gate. A latching device is cooperatively attached to the gate frame for "latching" the bolt upon encountering the same upon closure of the gate. A typical prior art latching device is provided with a rotating member which is configured to rotate about the bolt to thereby latch it in place. Such rotation is typically initiated by the contact of the bolt with a portion of the rotating member. As such, the speed of rotation of rotating member is proportional to the force and speed of the bolt at the time is impact the rotating member. Such a configuration, however, does not necessarily result in the bolt being latched when it is in its operable position within the latching device. For example, the rotating member may be susceptible to misalignment with respect to the bolt when in its operable position. Such misalignment may result in occurrences where the bolt impacts the rotating member, but such rotating member fails to rotate or fails to rotate at a sufficient speed so as to successfully latch the bolt thereat. In this respect, a person may attempt to latch the gate by closing the same but nonetheless fail to do so. As one can appreciate, such latching failures presents significant safety concerns. The is especially the case where there are small children or pets present in the residential context.

Accordingly, there is a need in the art for a gate latching assembly which readily engages a bolt upon contact therewith for securing the same.

SUMMARY OF THE INVENTION

In accordance with the present invention, there is provided a latching assembly for use with a gate having a bolt extending therefrom and the gate rotates relative to a gate frame. The latching assembly may be attached to the gate frame for releasably securing the bolt and therefore the gate with the gate frame. The latching assembly is provided with a housing and a bolt retaining member pivotally connected to the housing. The bolt retaining member has a retaining portion. The bolt retaining member has open and closed positions with the bolt retaining member being biased in the closed position. Preferably, a retaining member spring disposed in operable communication with the bolt retaining member and the housing for biasing the bolt retaining member in the closed position.

The latching assembly is further provided with a trigger connected to the housing. The trigger has locked and unlocked positions with the trigger being biased in the locked position. The trigger has a contact portion sized and configured to contact a bolt when the trigger mechanism is in the locked position. The trigger further has a locking portion sized and configured to engage the bolt retaining member when the bolt retaining member is in the open position and the trigger is in the locked position. The retaining portion and the contact portion are cooperatively sized and configured to retain a bolt therebetween when the bolt retaining member is in the closed position and the trigger is in the unlocked position. Preferably, the trigger is pivotally connected to the housing, and a trigger spring disposed in operable communication with the trigger and the housing for biasing the trigger in the locked position.

It is contemplated that the bolt defines a bolt plane of movement. In one embodiment of the present invention, the bolt retaining member is generally planar and thus defines a bolt retaining member pivot plane. A retaining member pivot axis extends perpendicular from the pivot plane and is disposed generally parallel to the bolt plane of movement. As such, the retaining member pivot plane is disposed generally perpendicular to the bolt plane of movement. In addition, the locking portion of the trigger may comprise a trigger notch formed in the trigger and the bolt retaining member may be provided with a stub extending therefrom for engaging the trigger notch.

In another embodiment of the present invention, the bolt retaining member may be configured to pivot about a retaining member pivot axis which is generally perpendicular to the bolt plane of movement. In the regard, the bolt retaining member may be provided with a leg portion which defines a retaining member pivot axis and the retaining portion may be formed to be generally tubular shaped. Preferably, the leg and retaining portions are disposed generally parallel to each other with the retaining portion being sized and configured to rotate about the leg portion. The locking portion of the trigger may comprise a trigger opening formed through the trigger and the leg portion may have a stub extending radial therefrom for engaging the trigger opening.

In the preferred embodiment of the present invention, the latching assembly is further provided with a retractable safety pin and the housing is sized and configured to receive the safety pin therethrough for engaging the bolt retaining member. In this regard, the safety pin may be configured to restrain the bolt retaining member in the open or closed positions.

The latching assembly constructed in accordance with the present invention presents numerous advantages not found in the related prior art. In this respect, the latching assembly of the present invention is particularly adapted to securely capture and retain a gate bolt through the usage of the trigger and biased trigger mechanism configuration. Unlike the typical prior art gate latching devices, the present invention is provided the bolt retaining member which is biased to move into its closed position upon the "unlocking" of the trigger. As mentioned above, a spring may be provided to bias the bolt retaining member, and as one of ordinary skill in the art will recognize the spring constant of which can be selected to provide for a relatively rapid movement of the bolt retaining member into the closed position. In this respect, the force and speed of rotation of the bolt retaining member is not proportional to the force and speed of movement of the bolt as in prior art devices. All that is required is that the bolt and gate combination have sufficient force to disengage the trigger from its locked position upon contact between the bolt and contact portion of the trigger. As such, the present invention tends to mitigate latching failures of the bolt when it is moved into its operable position within the gate latching assembly. Consequently, the present invention tends to enhance safety by mitigating such failures where a user intends to have the associated gate closed and latched.

In addition, another safety aspect of the present invention is the incorporation of the safety pin. As briefly discussed above, the safety pin can be used to prevent movement of the bolt restraining member. Thus, the bolt restraining member can be confined to its open or closed positions. In this respect, the bolt, and therefore the gate, can be either latched into place or prevented from being latched into place.

Advantageously, the present latching assembly may be used with those existing gates having common gates bolts. Thus, users may "safety" retrofit their gates by replacing the prior art latch device with that of the present invention while still using the existing bolt.

As such, the latching assembly constructed in accordance with the present invention represents a significant advancement in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENTS

Figure 1:
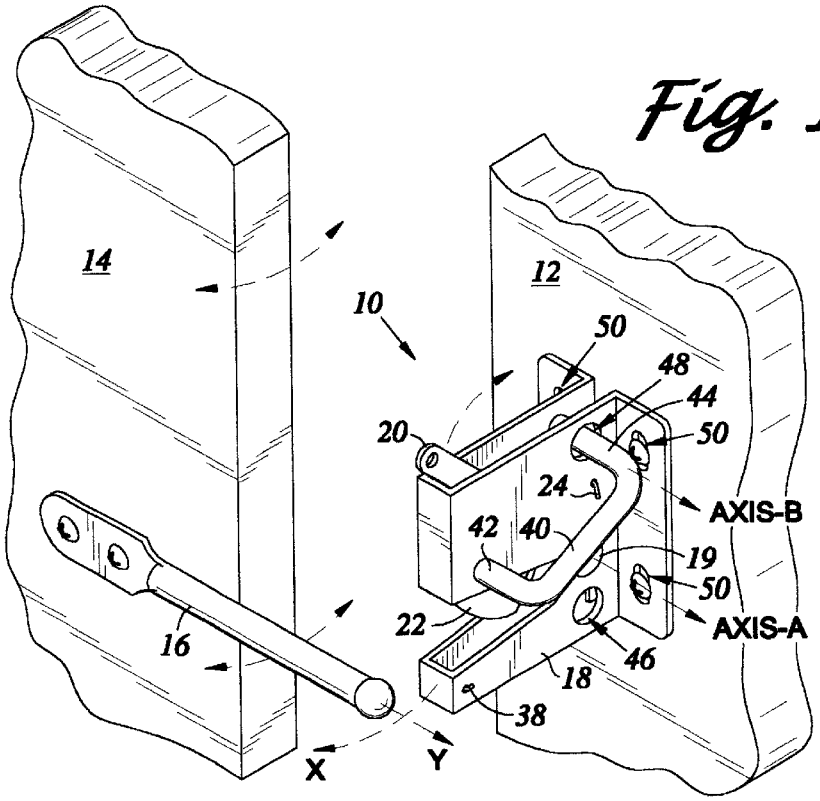
FIG. 1 is perspective view of the gate latching assembly of the present invention symbolically shown with a gate and gate frame.

Referring now to the drawings wherein the showings are for purposes of illustrating preferred embodiments of the present invention only, and not for purposes of limiting the same, FIGS. 1–8 illustrate a gate latching assembly constructed in accordance with the present invention. As will be described in more detail below, the latching assembly is specifically adapted to engage a bolt which extend from a gate upon contact therewith for securing the same.

Referring now to FIG. 1, in accordance with the present invention, there is provided a gate latching assembly 10. In the preferred embodiment, as symbolically depicted, the gate latching assembly 10 is mounted to a gate frame 12. The gate frame 12 is disposed adjacent a gate 14 having a gate bolt 16 extending therefrom. The gate 14 is typically hingedly mounted with the gate bolt 16 radially extending therefrom and the gate bolt 16 generally defining a bolt plane of movement (X-Y). The gate frame 12, gate 14 and gate bolt 16 are cooperatively sized and configured such that the gate bolt 16 contacts the gate latching assembly 10 upon sufficient rotational movement of the gate 14.

Figure 4:
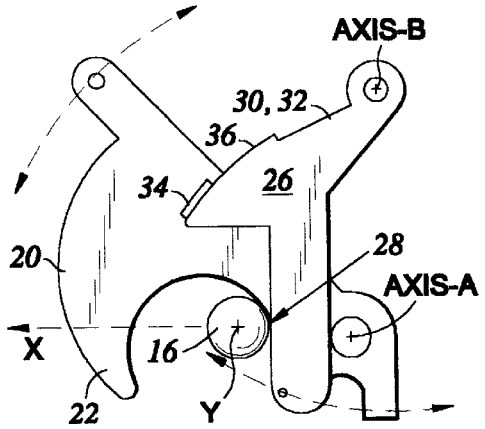
FIG. 4 is side view of the bolt retaining member and trigger of FIG. 3.
Figure 3:
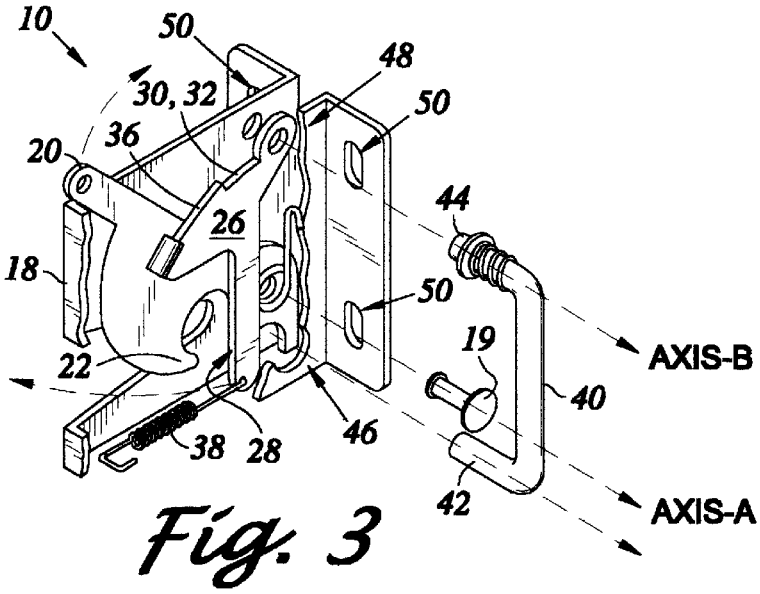
FIG. 3 is perspective partial exploded view of the gate latching assembly of the present invention symbolically shown with a bolt retaining member thereof in a closed position.
Figure 6:
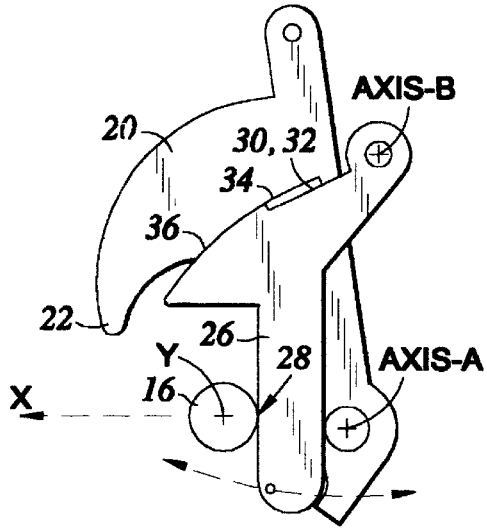
FIG. 6 is side view of the bolt retaining member and trigger of FIG. 5.
Figure 5:
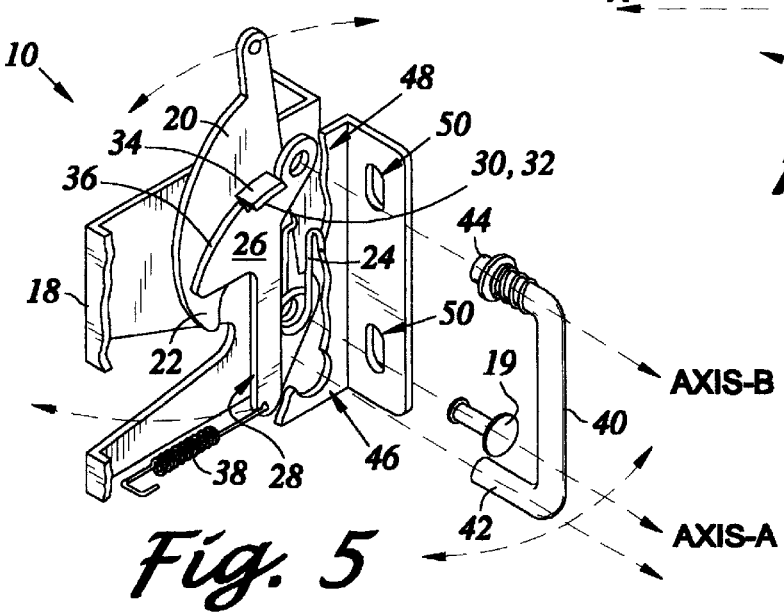
FIG. 5 is perspective partial exploded view of the gate latching assembly of the present invention symbolically shown with a bolt retaining member thereof in an open position.

Referring to FIGS. 1–6, there is depicted a first embodiment of the present invention. As can be seen, the latching assembly 10 is provided with a housing 18 and a bolt retaining member 20 which is pivotally connected to the housing 18. In this regard a pivot pin 19 may be provided. The bolt retaining member 20 has a retaining portion 22. The bolt retaining member 20 has open and closed positions. FIGS. 1–4 depict the bolt retaining member 20 is its closed position and FIGS. 5–6 depict the bolt retaining member in its open position. Importantly, the bolt retaining member 20 is biased in the closed position.

The bolt retaining member 20 may be formed to be generally flat or planar, and thus defines a bolt retaining member pivot plane. The bolt retaining member 20 may be configured to rotate within such plane. In this regard, a retaining member pivot axis (axis-A) extends perpendicular from such pivot plane and is disposed generally parallel to the bolt plane of movement (X-Y). As such, the retaining member pivot plane is disposed generally perpendicular to the bolt plane of movement (X-Y). Thus, the bolt retaining member 20 pivots about a retaining member pivot axis (axis-A) which is generally parallel to the bolt plane of movement (X-Y).

As mentioned above, the retaining member 20 is biased in the closed position. In this regard, a retaining member spring 24 disposed in operable communication with the bolt retaining member 20 and the housing 18 for biasing the bolt retaining member 20 in the closed position. Preferably, the spring 24 is a torsion helical spring as shown, however, the particular form of the spring 24 may be chosen from any of those which are well known to one of ordinary skill in the art.

Figure 2:
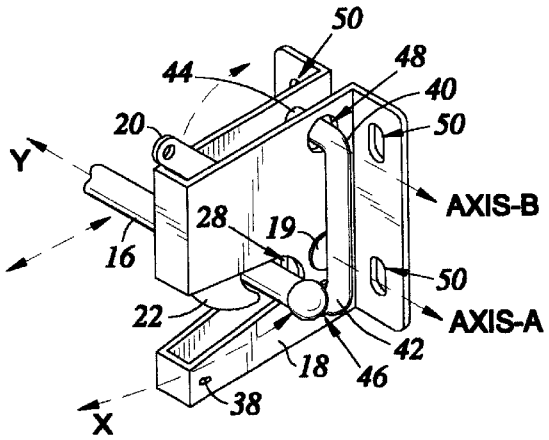
FIG. 2 is perspective view of the gate latching assembly of the present invention symbolically shown with a bolt retaining member thereof in a closed position.

It is further contemplated that the latching assembly 10 is further provided with a trigger 26 connected to the housing 18. The trigger 26 has locked and unlocked positions with the trigger 26 being biased in the locked position. Preferably in such embodiment of the present invention, the trigger 26 is pivotally connected to housing 18. In this regard, the trigger 26 may be formed to rotate about a trigger axis of rotation (axis-B) which may be parallel to the retaining member pivot axis (axis-A). Further, the trigger 26 is formed to have a contact portion 28 which is sized and configured to contact the bolt 16 when the trigger 26 is in the locked position, as shown in FIGS. 5 and 6. The trigger 26 further has a locking portion 30 which sized and configured to engage the bolt retaining member 20 when the bolt retaining member 20 is in the open position and the trigger 26 is in the locked position. Importantly, the retaining portion 22 of the bolt retaining member 20 and the contact portion 28 of the trigger 26 are cooperatively sized and configured to retain the bolt 16 therebetween when the bolt retaining member 20 is in the closed position and the trigger 26 is in the unlocked position, as depicted in FIGS. 2 and 4.

In practice, it is contemplated that the latching assembly 10 is in its operable configuration to receive, and thereby latch, the gate bolt 16 when the bolt retaining member 20 is in the open position and the trigger 26 is in the locked position, as depicted in FIGS. 5 and 6. Upon closure of the gate 14, the attached gate bolt 16 is contemplated to sweep across the bolt plane of movement (X-Y) towards the latching assembly 10, and in particular, the contact portion 28 of the trigger 26. The bolt 16 is contemplated to physically impact the contact portion 28 arid to cause the trigger 26 to rotate from the locked position to the unlocked position with the bolt retaining member 20 becoming disengaged from the locking portion 30 of the trigger 26. Such disengagement releases the biased bolt retaining member 20 thereby facilitating the retaining member 20 to rotate to its closed position.

Preferably, the locking portion 30 of the trigger 26 comprises a trigger notch 32 formed in the trigger 26. Further, the bolt retaining member 20 may be provided with a stub 34 which extends therefrom for engaging the trigger notch 32. The trigger may have an outer edge 36 which is disposed adjacent the trigger notch 32 and the trigger 26 may be biased to pivot with the outer edge 36 thereof being in slidable engagement with the stub 34 when the bolt retaining member 20 is intermediate the open and closed positions. In this regard, upon positioning the bolt retaining member 20 into the open position from the closed position, the biasing of the trigger 26 facilitates engagement of the stub 34 with the trigger notch 32 thereby placing trigger 26 in the locked position. It is contemplated that a trigger spring 38 may disposed in operable communication with the trigger 26 and the housing 18 for biasing the trigger 26 in the locked position. The trigger spring 38 by take the form of a extension spring as depicted or may be chosen from those which are well known to one of ordinary skill in the art.

As a safety feature, the latching assembly 10 of the present invention may be provided with a safety pin 40. The housing 18 may be sized and configured to receive the safety pin 40 therethrough for engaging the bolt retaining member 20. In the preferred embodiment, the bolt retaining member 20 is sized and configured to engage the safety pin 40 when the safety pin 40 is received by the housing 18 and the bolt retaining member 20 is in either the open or closed positions. In this regard, the safety pin 40 when in its operable position may be positioned perpendicular to the plane of rotation of the bolt retaining member 20. The safety pin 40 may be configured to be generally U-shaped with an insertion end 42 and a support end 44. Further, the housing 18 may be conveniently provided with an insertion opening 46 for receiving the insertion end 42 of the safety pin 40 therethrough for restraining rotation of the bolt retaining member 20, as depicted in FIG. 2.

Additionally, the housing 18 may be provided with a support opening 48 therethrough which is sized and configured to receive the support end 44 of the safety pin 40 for supporting the same. The safety pin 40 may be attached to the housing 18 such that the support end 44 is disposed in rotational and slidable communication with the support opening 48. Moreover, the safety pin 40 may be provided with a retraction spring for biasing the safety pin 40 towards the housing 18. It is contemplated that the insertion end 42 of the safety pin 40 may be disengaged with the insertion opening 46 and the safety pin 40 rotated. As the safety pin 40 is biased towards the housing 18, the insertion end of the safety pin 40 may be allowed to contact the housing 18 without interfering with the rotation of the bolt restraining member 20, as depicted in FIG. 1.

Advantageously, the support end 44 may be configured to rotate about an axis of rotation which is collocated with pivot axis of the trigger (axis-B). In this regard, the support end 44 may serve the dual function of supporting the safety pin 40 as well as pivotally attaching the trigger 26 with the housing 18.

As mentioned above, the latching assembly 10 is contemplated to be mounted to or otherwise attachable to a gate frame 12. In this regard, the housing 18 may be provided with several attachment openings 50. The attachment openings are preferably elongate for facilitating positional adjustment of the latching assembly relative to the bolt plane of movement (X-Y).

Figure 7:
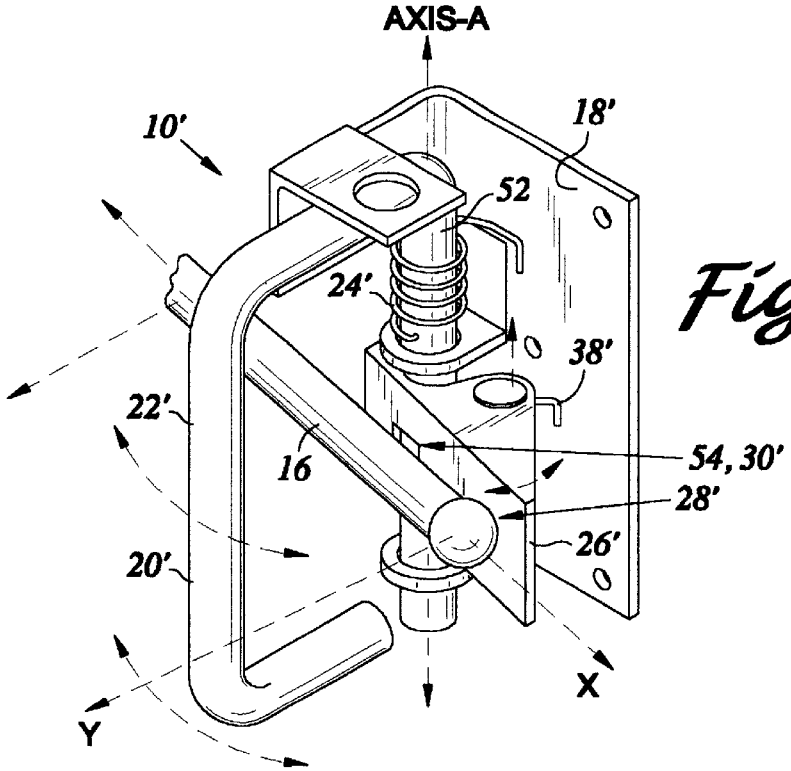
FIG. 7 is perspective view of another embodiment of the gate latching assembly of the present invention symbolically shown with a bolt retaining member thereof in a closed position.
Figure 8:
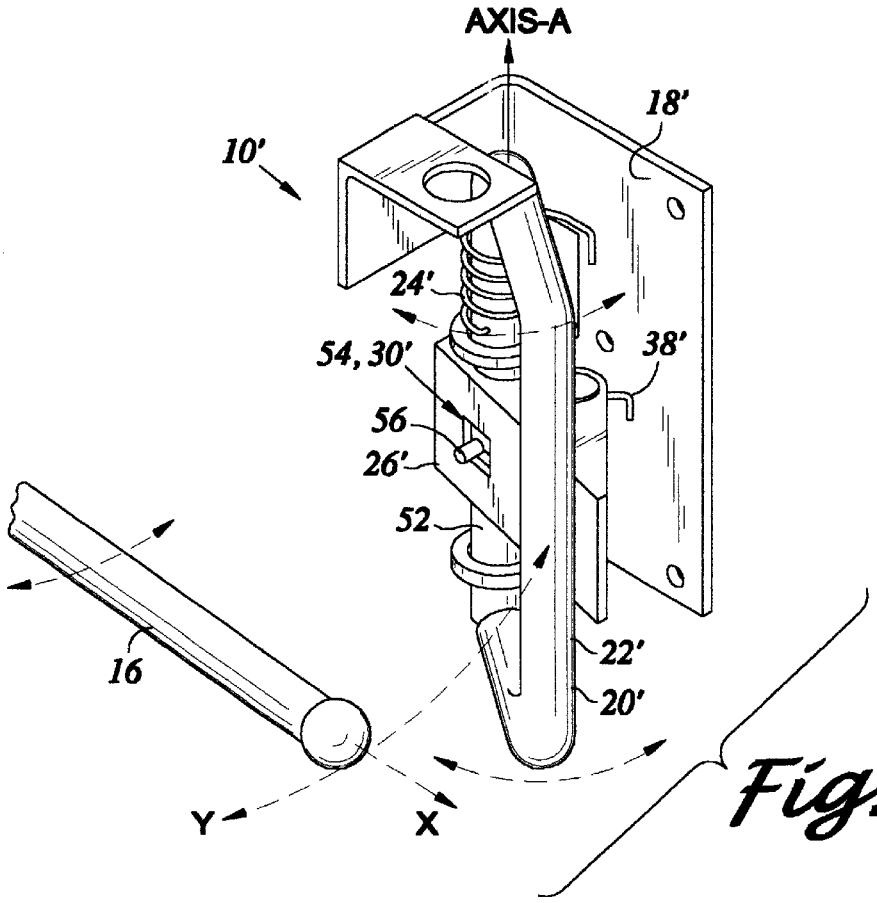
FIG. 8 is perspective view of another embodiment of the gate latching assembly of the present invention symbolically shown with a bolt retaining member thereof in an open position.

Referring now to FIG. 7 and 8, there is depicted another embodiment of the present invention. In this regard, there is depicted a latching assembly 10' having a housing 18'. A bolt retaining member 20' is pivotally attached to the housing 18' and pivots about a retaining member pivot axis (axis-A') which is generally perpendicular to the bolt plane of movement (X-Y). The bolt retaining member 20' is configured to have an open position (as shown in FIG. 8) and a biased closed position (as shown in FIG. 7). The bolt retaining member 20' is formed to be generally D-shaped and constructed of a generally tubular material. The bolt retaining member 20' has a retaining portion 22' and a parallel leg portion 52. The leg portion may be configured to define the retaining member pivot axis (axis-A'). In this regard, the retaining portion 22' may be sized and configured to rotate about the leg portion 52.

The latching assembly 10' may be further provided with a trigger 26' having a locking portion 30' thereof in the form of a trigger opening 54. In addition, the leg portion 52 may have a stub 56 extending radial therefrom for engaging the trigger opening 54. The trigger 26' has a biased locked position when it is engaged with the bolt retaining member 20'. Preferably in this embodiment of the present invention, the trigger 26' is in a locked position when the stub 56 is engaged with the trigger opening 54 as shown in FIG. 8. In addition, a biasing spring 24' may be disposed in operable communication with the bolt retaining member 20' and the housing 18' for biasing the bolt retaining member 20' towards its closed position. Moreover, a trigger spring 38' may be disposed on operable communication with trigger 26' and the housing 18'. The trigger is contemplated to have a contact portion 28' which is sized and configured to engage the bolt 16. The bolt 16 is contemplated to physically impact the contact portion 28' to cause the trigger 26' to rotate from the locked position to the unlocked position with the stub 56 becoming disengaged from the trigger opening 54. Such disengagement releases the biased bolt retaining member 20' thereby facilitating the retaining member 20' to rotate to its closed position.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A latching assembly for securing a gate having a bolt extending therefrom, the latching assembly comprising:

a housing;

a bolt retaining member pivotally connected to the housing, the bolt retaining member having a retaining portion, the bolt retaining member having open and closed positions with the bolt retaining member being biased in the closed position; and a trigger connected to the housing, the trigger having locked and unlocked positions with the trigger being biased in the locked position, the trigger having a contact portion sized and configured to contact the bolt when the trigger is in the locked position, the trigger further having a locking portion sized and configured to engage the bolt retaining member when the bolt retaining member is in the open position and the trigger is in the locked position;

wherein the retaining portion of the bolt retaining member and the contact portion of the trigger being cooperatively sized and configured to retain a bolt therebetween when the bolt retaining member is in the closed position and the trigger is in the unlocked position.

2. The latching assembly of claim 1 wherein the locking portion of the trigger comprises a trigger notch formed in the trigger.

3. The latching assembly of claim 2 wherein the bolt retaining member has a stub extending therefrom for engaging the trigger notch.

4. The latching assembly of claim 3 wherein the trigger has an outer edge disposed adjacent the trigger notch, the trigger is biased to pivot with the outer edge thereof in slidable engagement with the stub when the bolt retaining member is intermediate the open and closed positions.

5. The latching assembly of claim 1 further comprises a retaining member spring disposed in operable communication with the bolt retaining member and the housing for biasing the bolt retaining member in the closed position.

6. The latching assembly of claim 5 wherein the retaining member spring is a helical spring.

7. The latching assembly of claim 1 wherein the bolt retaining member is generally planar.

8. The latching assembly of claim 1 wherein the bolt defines a bolt plane of movement, the bolt retaining member defines a bolt retaining member pivot plane which is perpendicular to the bolt plane of movement.

9. The latching assembly of claim 1 wherein the bolt defines a bolt plane of movement, the bolt retaining member pivots about a retaining member pivot axis which is generally parallel to the bolt plane of movement.

10. The latching assembly of claim 1 wherein the bolt defines a bolt plane of movement, the bolt retaining member pivots about a retaining member pivot axis which is generally perpendicular to the bolt plane of movement.

11. The latching assembly of claim 1 wherein the bolt retaining member has a leg portion which defines a retaining member pivot axis, the retaining portion is generally tubular shaped.

12. The latching assembly of claim 11 wherein the leg and retaining portions are disposed generally parallel to each other.

13. The latching assembly of claim 11 wherein the retaining portion is sized and configured to rotate about the leg portion.

14. The latching assembly of claim 11 wherein the bolt retaining member is formed of an elongate tubular material.

15. The latching assembly of claim 1 wherein the locking portion of the trigger comprises a trigger opening formed through the trigger, the leg portion has a stub extending radial therefrom for engaging the trigger opening.

16. The latching assembly of claim 1 wherein the trigger is pivotally connected to the housing.

17. The latching assembly of claim 1 further comprises a trigger spring disposed in operable communication with the trigger and the housing for biasing the trigger in the unlocked position.

18. The latching assembly of claim 1 further comprises a safety pin, the housing being sized and configured to receive the safety pin therethrough for engaging the bolt retaining member.

19. The latching assembly of claim 18 wherein the bolt retaining member is sized and configured to engage the safety pin when the safety pin is received by the housing and the bolt retaining member is in the open position.

20. The latching assembly of claim 18 wherein the bolt retaining member is sized and configured to engage the safety pin when the safety pin is received by the housing and the bolt retaining member is in the closed position.

21. The latching assembly of claim 18 wherein the bolt retaining member defines a plane of rotation and the safety pin is positioned perpendicular to the plane of rotation when received by the housing.

22. The latching assembly of claim 18 wherein the safety pin is provided with a retraction spring for biasing the safety pin towards the housing.

23. A latching assembly for securing a gate having a bolt extending therefrom, the bolt defining a plane of movement, the latching assembly comprising:

a housing;

a bolt retaining member pivotally connected to the housing and sized and configured to rotate about a retaining member pivot axis generally parallel to the bolt plane of movement, the bolt retaining member having a retaining portion, the bolt retaining member having open and closed positions with the bolt retaining member being biased in the closed position; and a trigger connected to the housing, the trigger having locked and unlocked positions with the trigger being biased in the locked position, the trigger having a contact portion sized and configured to contact the bolt when the trigger is in the locked position, the trigger further having a locking portion sized and configured to engage the bolt retaining member when the bolt retaining member is in the open position and the trigger is in the locked position;

wherein the retaining portion of the bolt retaining member and the contact portion of the trigger being cooperatively sized and configured to retain a bolt therebetween when the bolt retaining member is in the closed position and the trigger is in the unlocked position.

24. A latching assembly for securing a gate having a bolt extending therefrom, the bolt defining a plane of movement, the latching assembly comprising:

a housing;

a bolt retaining member pivotally connected to the housing, the bolt retaining member having a retaining defining a retaining member pivot axis, retaining portion being sized and configured to rotate about the portion, the bolt retaining member having open and closed positions with the bolt retaining member being biased in the closed position; and a trigger connected to the housing, the trigger having locked and unlocked positions with the trigger being biased in the locked position, the trigger having a contact portion sized and configured to contact the bolt when the trigger is in the locked position, the trigger further having a locking portion sized and configured to engage the bolt retaining member when the bolt retaining member is in the open position and the trigger is in the locked position;

wherein the retaining portion of the bolt retaining member and the contact portion of the trigger being cooperatively sized and configured to retain a bolt therebetween when the bolt retaining member is in the closed position and the trigger is in the unlocked position.

* * * * *